United States Patent [19]

Hallissy et al.

[11] Patent Number: 4,715,450

[45] Date of Patent: Dec. 29, 1987

[54] GRADER BLADE WITH CASTING/INSERT ASSEMBLY ON LEADING EDGE

[75] Inventors: Robert P. Hallissy, Jeannette; Edmund Isakov; Earle W. Stephenson, both of Latrobe; Don C. Rowlett, Bedford, all of Pa.

[73] Assignee: Kennametal Inc., Latrobe, Pa.

[21] Appl. No.: 17,106

[22] Filed: Feb. 20, 1987

[51] Int. Cl.[4] ..... E02F 3/815

[52] U.S. Cl. ..... 172/701.3; 172/747; 37/141 R

[58] Field of Search ..... 37/266, 141 R; 172/745, 172/747, 701.1, 701.3; 299/79, 88, 93; 175/410

[56] References Cited

U.S. PATENT DOCUMENTS

| | | | |
|---|---|---|---|
| 1,922,917 | 8/1953 | Russel et al. | 37/141 R |
| 3,529,677 | 9/1970 | Stephenson | 172/767 |
| 3,790,353 | 2/1974 | Jackson et al. | 29/182.7 |
| 3,888,027 | 6/1975 | Toews | 37/141 R |
| 3,934,654 | 1/1976 | Stephenson et al. | 172/719 |
| 3,971,323 | 7/1976 | Beiswenger | 104/10 |
| 3,984,910 | 10/1976 | Helton et al. | 29/420 |
| 4,024,902 | 5/1977 | Baum | 164/97 |
| 4,052,802 | 10/1977 | Moen et al. | 37/141 R |
| 4,140,170 | 2/1979 | Baum | 164/51 |
| 4,146,080 | 3/1979 | Baum | 164/97 |
| 4,359,335 | 11/1982 | Garner | 175/410 |
| 4,428,260 | 1/1984 | Eby | 76/104 R |
| 4,498,549 | 2/1985 | Jurgens | 175/410 |
| 4,608,318 | 8/1986 | Makrides et al. . | |

FOREIGN PATENT DOCUMENTS

| | | | |
|---|---|---|---|
| 0046209A1 | 2/1982 | European Pat. Off. . | |
| 2605986 | 8/1977 | Fed. Rep. of Germany | 299/79 |
| 3404030 | 7/1985 | Fed. Rep. of Germany | 37/266 |

OTHER PUBLICATIONS

"Sintered Carbides", A.S.M. Committee on Sintered Carbides, Nov. 78, pp. 659–668.

"Metal Progress Datebook, 1978", pp. 55,and 77.

Kengard A. Grader Blades (WS85-24), published 1985.

Metals Handbook, vol. 7, Powder Metallurgy, (1984), pp. 6, 552–566.

Publication: Kengard A. Grader Blades, dated 8/1983, by Kennametal, Inc.

*Primary Examiner*—Edgar S. Burr

*Assistant Examiner*—Joseph McCarthy

*Attorney, Agent, or Firm*—John J. Prizzi

[57] ABSTRACT

A grader blade has a steel body with a bottom edge incorporating a substrate of air-hardened tool steel casting material assembling a preformed cemented carbide insert in tiered relationship with, and rearwardly of, a casted layer of carbide grit. The front casted carbide grit layer is formed in the casting operation and the rear preformed cemented carbide insert is arranged in the tiered contacting and attached relationship with the carbide grit layer as the latter is casted with the substrate of special steel casting that holds the insert and layer together. The steel body of the blade also includes a recess formed in and along the forward portion of the blade bottom edge into which the casted asembly is disposed and welded to the blade. The front casted layer of carbide grit is tougher than the rear preformed carbide insert making it better able to absorb impacts thereon, whereas the rear insert is composed of a cemented carbide composition having a low cobalt content, for instance ten percent by weight, adapting it for enhanced downpressure wear resistance.

12 Claims, 5 Drawing Figures

GRADER BLADE WITH CASTING/INSERT ASSEMBLY ON LEADING EDGE

CROSS REFERENCE TO RELATED APPLICATION

Reference is hereby made to the following copending application dealing with related subject matter and assigned to the assignee of the present invention: "Grader Blade with Tiered Inserts on Leading Edge" by Robert P. Hallissy et al, assigned U.S. Ser. No. 017,394 and filed Feb. 20, 1987.

BACKGROUND OF THE INVENTION

1. Field of the Invention

The present invention generally relates to blades for graders, snow plows and the like and, more particularly, is concerned with a grader blade having welded thereto a casting/insert assembly adapting its bottom forward edge for improved impact and downpressure wear resistance.

2. Description of the Prior Art

Graders and snow plows are both well known and each have a relatively long moldboard which extends generally laterally of the surface being worked and is moved over the surface in a direction generally perpendicular to the length of the moldboard. It is conventional practice to mount a grader blade made of steel on the lower edge of such moldboard with the blade, in turn, extending downwardly below the moldboard lower edge and itself havig a lower edge forming the working surface of the blade.

Grader blades made of steel have the advantage of being relatively inexpensive, but also the disadvantage of wearing out extremely rapidly. Once worn out, the steel blade must be replaced to avoid damage to the moldboard itself. The replacing of the steel blade is, of course, time consuming and also represents downtime for the equipment. Thus, over the years, various techniques, such as impregnation and hardfacing of the blade cutting edge with carbide particles, and attachment of cemented carbide inserts into or onto the blade edge have been employed in attempting to prolong the life of the steel blade. Some of these prior art techniques are used with blades disclosed in U.S. Patents to Russell et al (U.S. Pat. No. 1,922,917), Stephenson (U.S. Pat. No. 3,529,677), Jackson et al (U.S. Pat. No. 3,790,353), Beiswenger (U.S. Pat. No. 3,971,323), Toews (U.S. Pat. No. 3,888,027), Stephenson et al (U.S. Pat. No. 3,934,654) and Moen et al (U.S. Pat. No. 4,052,802), and a blade identified as Kengard A grader blade manufactured by Kennametal Corporation.

While many of these prior art blades would appear to operate reasonably well under the limited range of operating conditions for which they were designed, most seem to embody one or more shortcomings in terms of complexity, performance, reliability and cost effectiveness which make them less than an optimum design. Consequently, a need exists for a different approach to grader blade design, one which will more adequately address the kinds of wear and forces encountered by the lower end of the grader blade.

SUMMARY OF THE INVENTION

The present invention provides a grader blade designed to satisfy the aforementioned needs. The blade of the present invention is based on a double tiered cemented carbide principle—the one forward cemented carbide for face wear resistance primarily to impacts and the other rearward cemented carbide for downpressure wear resistance. In particular, the blade of the present invention has a bottom edge with a forward portion thereof incorporating a substrate of air-hardened tool steel casting material assembling a rear preformed cemented carbide insert in tiered relationship with a front casted layer of carbide grit. The carbide grit layer is formed in the casting operation and the carbide insert is arranged in the tiered contacting and attached relationship with the carbide grit layer as the latter is casted with the substrate that holds the insert and layer together. Then, the casted assembly is inserted into a recess formed in and along the forward portion of the blade bottom edge and the substrate is welded to the blade.

Generally speaking, the use of the two inserts in the bottom edge of a grader blade is known, for instance, in the prior art Kengard A grader blade. However, in contrast to the construction of the grader blade of the present invention, the prior art Kengard A grader blade has a front recess, and an intermediate slot spaced from the front recess, with the inserts respectively disposed in the recess and the slot. The front recess is formed along the forward bottom edge of the blade, whereas the intermediate slot is formed along and opens toward the bottom edge of the blade. The slot is defined between and spaced from the front recess and a rear surface of the blade by intermediate and rear bottom end sections of the steel blade body. The front recess contains a first insert composed of Kengard A material, a metal composite of tungsten carbide particles in a matrix of tough, work-hardening stainless steel. The intermediate slot contains a second insert composed of cemented tungsten carbide containing 10 to 13 weight percent cobalt. The inserts are brazed to the steel blade body including the intermediate and rear sections thereof. In another prior art Kengard grader blade, the two inserts were spaced close to one another.

The prior art Kengard A grade blade of such construction frequently experienced binder washout between the carbide particles in the composite metal matrix, braze failure due the inherent porosity of the matrix, and overall was not cost effective. The grader blade construction of the prsent invention eliminates these problems.

Accordingly, the present invention is directed to a grader blade, comprising: (a) a steel body having a bottom edge with a recess formed along a forward portion of said edge; and (b) a casted assembly composed of a rear preformed cemented carbide insert a front casted layer of carbide grit in combination with a substrate of casting material holding the insert and layer in a tiered contacting and attached relationship with one another, the casted assembly being disposed in the recess and the substrate welded to the body. The front casted layer of carbide grit has greater toughness than the rear carbide insert, whereas the rear carbide insert has greater downpressure wear resistance than the front casted layer of carbide grit.

More particularly, the rear insert is composed of a cemented carbide composition of low cobalt content adapting it for downpressure wear resistance, the cobalt content by weight being within the range of about 10 to 13 percent, and more preferably, 11.0 to 12.4 weight percent. Preferably, the composition of the rear insert by weight is about 88.5 percent tungsten carbide and 11.5 percent cobalt.

Still further, the casted layer of carbide grit is disposed substantially outside of the recess and forwardly of a front surface on the steel body. The carbide grit is metallurgically bonded in an air-hardening (Ni-Cr-Mo) steel matrix.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
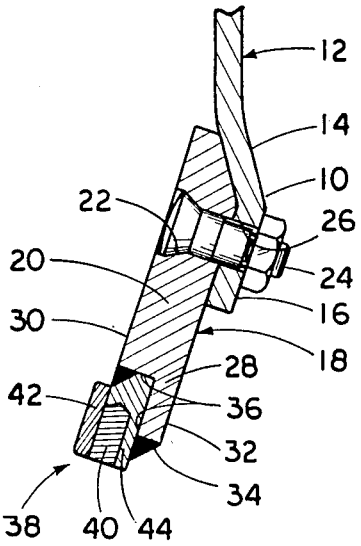
FIG. 1 is a vertical sectional view of the lower edge of a grader moldboard with a grader blade secured thereto having the construction of the present invention.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is partially shown the lower end 10 of a conventional moldboard 12, such as might be employed on a grader, scraper or snow plow. The moldboard lower end 10 has an inclined offset portion 14 and a straight terminal portion 16. A grader blade, generally designated by the numeral 18 and having the construction of the present invention, has an elongated steel body 20 with holes 22 defined in laterally spaced relation through the body. An upper end portion of the body 20 is shaped to conform to the combined contour of the inclined portion 14 and terminal portion 16 of the moldboard lower end 10 at a forward side of the moldboard 12 so as to facilitate rigid securement of the blade 18 to the moldboard 12 by bolts 24 inserted through the holes 22 in the body and through corresponding aligned holes 26 formed in the terminal portion 16 of the moldboard lower end 10.

Figure 2:
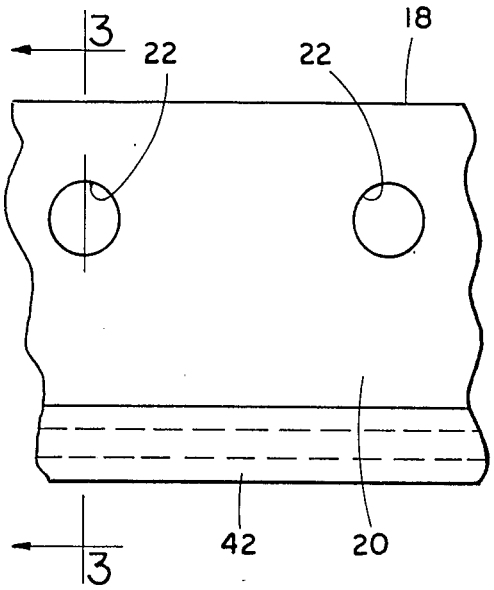
FIG. 2 is a fragmentary front elevational view of the blade removed from the moldboard.
Figure 3:
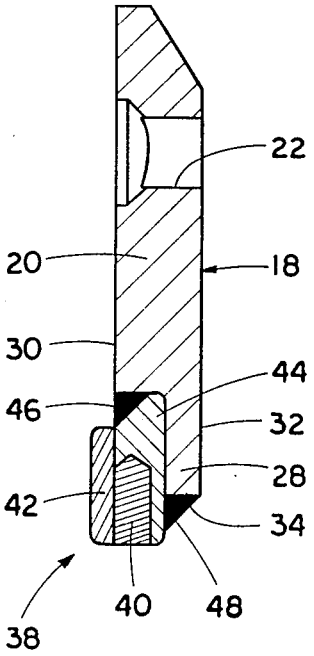
FIG. 3 is an enlarged vertical sectional view of the blade taken along line 3—3 of FIG. 2.
Figure 4:
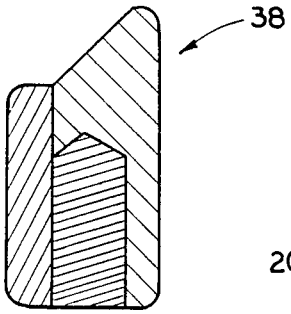
FIG. 4 is an enlarged cross-sectional view of the casted assembly incorporated by the grader blade of the present invention.

Turning now to FIGS. 2–4, in accordance with the construction of the grader blade 18 of the present invention, the body 20 of the blade 18 is composed of a steel alloy and has a bottom edge 28 defined by front, rear and bottom surfaces 30,32,34 of the steel body. The steel alloy is AISI 1020 in accordace with ASTM specification A36. Also, a recess 36, being preferably rectangular in cross-section, is formed in and along a forward portion of the blade body bottom edge 28 so as to open at both the front and bottom surfaces 30,34 thereof and be spaced from the rear surface 32 thereof.

The grader blade 18 includes a casted assembly, generally indicated by numeral 38, being composed of a rear preformed cemented carbide insert 40 and a front casted layer 42 of carbide grit in combination with a substrate 44 of casting material. The substrate 44 holds the insert 40 and layer 42 in a tiered contacting and attached relationship with one another. The casted assembly 38 is disposed in the recess 36 and the substrate 44 is welded to the body 20 such that the casted assembly 38, the insert 40 and layer 42, extend beyond the front and bottom surfaces 30,34 of the body edge 28 for contacting the surface being worked. In actuality, the casted layer 42 of carbide grit is disposed substantially outside of the recess 36 and forwardly of the front surface 30 on the steel body 20.

The front casted carbide grit layer 42 is formed in the operation when the parts of the assembly 38 are casted together. The carbide grit is composed of particles of up to one-quarter inch thick. The rear preformed cemented carbide insert 40 is arranged at that time in the tiered, contacting and attached relationship with the carbide grit layer 42 as the latter is casted along with the substrate 44 that holds the insert 40 and layer 42 together.

The front casted layer 42 of carbide grit is tougher than the rear preformed carbide insert 40 making it better able to absorb impacts thereon. On the other hand, the rear insert 40 is composed of a sintered cemented carbide composition having a low cobalt content adapting it for greater downpressure wear resistance than the front casted layer 42 of carbide grit. Preferably, the cobalt content by weight of the insert 40 is within the range of about 10 to 13 percent, and more preferably, 11.0 to 12.4 weight percent. Preferably, the composition of the rear insert 40 by weight is about 88.5 percent tungsten carbide and 11.5 percent cobalt.

The substrate 44 of casting material is composed of an air-hardening (Ni-Cr-Mo) steel material. Preferably, the matrix steel composition is nominally 4.0 Ni - 1.4 Cr - 0.3 Mo. During the metallurgical bonding, the matrix steel (around the carbide particles) alloys with tungsten and cobalt. The casting process if disclosed in detail in the Baum U.S. Pat. Nos. 4,024,902, 4,140,170, 4,146,080 and are incorporated herein by reference.

Figure 5:
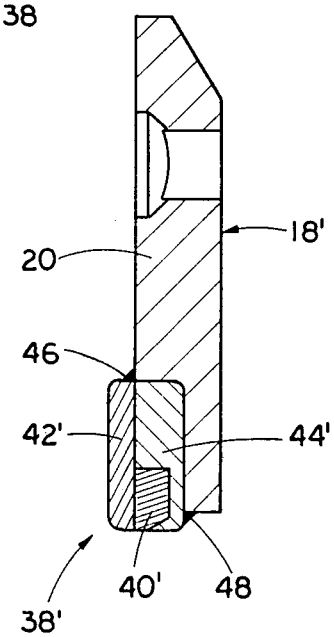
FIG. 5 is a vertical sectional view of a modified view of a modified form of a grader blade having the construction of the present invention.

Welds 46,48 are formed at diagonally opposite corners of the substrate 44 for attaching the casted assembly 38 within the recess 36 to the steel body 20. It will be noted that the substrate 44 occupies the majority of the space within the recess 36. This is even more in the case of the modified assembly 38' shown in FIG. 5. The substrate 44' in the assembly 38' is a more rectangular shape than the substrate 44 in the assembly 38 of FIGS. 3 and 4. The respective shapes and orientations of the inserts 40 and 40' of the respective assemblies 38 and 38' are to promote material flow in the casting operation.

To summarize, the carbide of the front layer is relatively tough making it capable of withstanding and absorbing impacts with the surface being worked which are directed to this region of the grader blade 18. The lower cobalt content of the rear insert means that, although relatively brittle and less tough, it will wear better than the front layer and thus better resist wear caused by downpressure on this region of the blade.

It is thought that the grader blade of the present invention and many of its attendant advantages will be understood from the foregoing description and it will be apparent that various changes may be made in the form, construction and arrangement of the parts and steps thereof without departing from the spirit and scope of the invention or sacrificing all of its material advantages, the form hereinbefore described being merely a preferred embodiment thereof.

We claim:

1. A grader blade comprising:

(a) a steel body having a bottom edge with a recess formed along a forward portion of said edge; and (b) a casted assembly composed of a rear prefromed cemented carbide insert and a front casted layer of carbide grit in combination with a substrate of casting material holding said insert and layer in a tiered contacting and attached relationship with one another, said casted assembly being disposed in said recess and said substrate welded to said body.

2. The blade as recited in claim 1, wherein said front casted layer of carbide grit has greater toughness than said rear carbide insert.

3. The blade as recited in claim 1, wherein said rear carbide insert has greater downpressure wear resistance than said front casted layer of carbide grit.

4. The blade as recited in claim 1, wherein said rear insert is composed of a cemented carbide composition of low cobalt content adapting it for downpressure wear resistance, said cobalt content by weight being within the range of about 10 to 13 percent.

5. The blade as recited in claim 4, wherein said composition of said rear insert by weight is about 88.5 percent tungsten carbide and 11.5 percent cobalt.

6. The blade as recited in claim 1, wherein said recess is rectangular-shaped in cross-section.

7. The blade as recited in claim 6, wherein said casted layer of carbide grit is disposed substantially outside of said recess and forwardly of a front surface on said steel body.

8. The blade as recited in claim 1, wherein said substrate of casting material includes an air-hardening steel.

9. The blade as recited in claim 1, wherein said front casted layer is composed of carbide particles metallurgically bonded in an air-hardening steel.

10. A grader blade, comprising:

(a) a steel body having a bottom edge defined by front, rear and bottom surfaces and recess formed in and along a forward portion of said bottom edge so as to open at said front and bottom surfaces thereof and be spaced forwardly of said rear surface thereof; and (b) a casted assembly composed of a rear preformed cemented carbide insert and a front casted layer of carbide grit in combination with a substrate of casting material holding said insert and layer in a tiered contacting and attached relationship with one another, said casted assembly being disposed in said recess and said substrate welded to said body such that said casted assembly extends beyond said front and bottom surfaces of said edge;

(c) said front casted layer of carbide grit having greater toughness than said rear carbide insert;

(d) said rear carbide insert has greater downpressure wear resistance than said front casted layer of carbide grit, said rear insert being composed of a cemented carbide composition of low cobalt content adapting it for said downpressure wear resistance, said cobalt content by weight being within the range of about 10 to 13 percent;

(e) said substrate of casting material being composed of an air-hardening steel.

11. The blade as recited in claim 10, wherein said composition of said rear insert by weight is about 88.5 percent tungsten carbide and 11.5 percent cobalt.

12. The blade as recited in claim 10, wherein said casted layer of carbide grit is disposed substantially outside of said recess, forwardly of a front surface on said steel body.

* * * * *